US008226812B2

(12) United States Patent
Nelvig et al.

(10) Patent No.: US 8,226,812 B2
(45) Date of Patent: Jul. 24, 2012

(54) CONTROL OF A CORROSION PROTECTION SYSTEM

(75) Inventors: Carl Nelvig, Göteborg (SE); Lennart Arvidsson, Kàllered (SE)

(73) Assignee: AB Volvo Penta, Göteborg (SE)

( * ) Notice: Subject to any disclaimer, the term of this patent is extended or adjusted under 35 U.S.C. 154(b) by 136 days.

(21) Appl. No.: 12/920,629

(22) PCT Filed: Mar. 19, 2008

(86) PCT No.: PCT/SE2008/000210
§ 371 (c)(1),
(2), (4) Date: Sep. 2, 2010

(87) PCT Pub. No.: WO2009/116901
PCT Pub. Date: Sep. 24, 2009

(65) Prior Publication Data

US 2011/0000794 A1 Jan. 6, 2011

(51) Int. Cl.
*C23F 13/04* (2006.01)
*C23F 13/06* (2006.01)
*C23F 13/22* (2006.01)

(52) U.S. Cl. ..... 205/740; 205/725; 205/727; 205/730; 204/196.02; 204/196.04; 204/196.06; 204/196.07; 204/196.1; 204/196.11; 204/196.21; 204/196.26; 204/196.36

(58) Field of Classification Search ..... 205/725, 205/727, 730, 740; 204/196.02, 196.04, 204/196.06, 196.07, 196.1, 196.11, 196.21, 204/196.26, 196.36
See application file for complete search history.

(56) References Cited

U.S. PATENT DOCUMENTS

| | | | | |
|---|---|---|---|---|
| 3,634,222 | A | 1/1972 | Stephens | |
| 3,953,742 | A * | 4/1976 | Anderson et al. | 204/196.03 |
| 4,060,461 | A * | 11/1977 | Seyl | 324/425 |
| 4,080,272 | A | 3/1978 | Ferry et al. | |
| 4,383,900 | A | 5/1983 | Garrett | |
| 4,492,877 | A * | 1/1985 | Staerzl | 204/196.02 |
| 5,216,370 | A * | 6/1993 | Bushman et al. | 324/425 |
| 5,298,794 | A * | 3/1994 | Kuragaki | 307/95 |
| 5,327,414 | A * | 7/1994 | Makino et al. | 369/59.12 |
| 6,183,625 | B1 * | 2/2001 | Staerzl | 205/727 |
| 7,044,075 | B2 | 5/2006 | Sica et al. | |
| 8,118,983 | B1 * | 2/2012 | Anderson et al. | 204/196.11 |
| 2006/0054072 | A1 * | 3/2006 | Sica et al. | 114/222 |

(Continued)

FOREIGN PATENT DOCUMENTS

EP 0018522 A1 11/1980

(Continued)

OTHER PUBLICATIONS

JP8133184 A, Itani Jiyun (abstract), May 28, 1996.

(Continued)

*Primary Examiner* — Bruce Bell
(74) *Attorney, Agent, or Firm* — WRB-IP LLP

(57) ABSTRACT

A method in a corrosion protection system for protecting a first and a second metal part of a marine construction is provided. The method includes controlling electrical currents through electrical circuits, including respective anodes, the respective metal parts and an electrolyte, at least partly based on measured electrical potentials of the respective metal parts with an reference electrode as a ground reference. The method further includes repetitively performing the steps of controlling the electrical currents so as to be reduced or eliminated, measuring the electrical potentials while the electrical currents are maintained reduced or eliminated, and, after measuring the first and second electrical potentials, controlling the electrical currents so as to be increased or reestablished.

16 Claims, 6 Drawing Sheets

U.S. PATENT DOCUMENTS

| | | | | |
|---|---|---|---|---|
| 2006/0065551 | A1 | 3/2006 | Howard et al. | |
| 2011/0083973 | A1 * | 4/2011 | Nelvig | 205/724 |
| 2011/0089048 | A1 * | 4/2011 | Nelvig et al. | 205/730 |

FOREIGN PATENT DOCUMENTS

| | | | |
|---|---|---|---|
| GB | 1174761 | A | 12/1969 |

OTHER PUBLICATIONS

International Search Report for corresponding International Application PCT/SE2008/000210.
International Preliminary Report on Patentability for corresponding International Application PCT/SE2008/000210.

* cited by examiner

CONTROL OF A CORROSION PROTECTION SYSTEM

BACKGROUND AND SUMMARY

The present invention relates to a corrosion protection system for protecting a first and a second metal part of a marine construction, such as a marine surface vessel or a marine structure, the system comprising a first and a second anode and at least one reference electrode, the metal parts, the anodes, and the reference electrode being adapted to be at least partly immersed in an electrolyte in the form of water in which the marine construction is at least partly immersed. The invention also relates to a marine vessel with such a system, and also to a method in such a system. The method comprises controlling a first electrical current through a first electrical circuit, comprising the first anode, the first metal part and the electrolyte, at least partly based on a measured first electrical potential of the first metal part with at least one of the at least one reference electrode as a ground reference, and controlling a second electrical current through a second electrical circuit, comprising the second anode, the second metal part and the electrolyte, at least partly based on a measured second electrical potential of the second metal part with at least one of the at least one reference electrode as a ground reference.

In marine constructions, such as marine vessels and marine structures, a known way to protect an immersed metal part against galvanic corrosion is to provide a sacrificial anode, made of very pure zinc, magnesium, cast iron or an alloy of aluminum, which is directly fastened to, or electrically connected via a cable to the immersed metal part. In such a system, herein referred to as a passive corrosion protection system, or simply a passive system, the sacrificial anode will waste away, preventing damage to the immersed metal part.

An alternative to passive arrangements with sacrificial anodes is impressed current cathodic protection (ICCP) systems. In such a system, one or more active anodes are immersed and connected along with the immersed metal part to a common DC electrical power source. ICCP system active anodes usually have tubular or solid rod shapes, or are provided as continuous ribbons, and can include materials such as titanium, platinum, high silicon cast iron, graphite, mixed metal oxide, and niobium. Regardless whether the corrosion protection system is a passive system or of the ICCP type, a circuit is provided by an electrical current through the water serving as an electrolyte, and a surface polarization at the interface between the metal part and the water is created, serving to protect the metal part against corrosion.

In a passive system, as well as in an ICCP system, for a good corrosion protection, the electrical current between the anode and the metal part should be such that the surface polarization of the metal part is kept close to a desired value, or a desired interval, which depends on the material of the metal part. If said current is too low, the protection is too low, and the metal part will corrode at an undesired rate. For some metals, e.g. aluminum, damages can occur also if the current is too high. In general, too high of a current between the anode and the metal part gives calcium oxide precipitation which can stimulate excessive growth of sea weeds and sea animals on the metal part. Such growth is a particularly large concern in the case of recreational boats, which often stay docked giving opportunities for the growth.

ICCP systems usually include an electronic control unit (ECU) by means of which the electrical current between the anode and the metal part can be varied and controlled, which allows for control of the current between the anode and the metal part through the electrolyte, and thereby control of the surface polarization at an interface between the metal part and the electrolyte. Also passive systems can include such control, which can be obtained by an adjustable resistance in the electrical connection between the sacrificial anode and the metal part, for example as described in U.S. Pat. No. 5,627,414.

The control of the current is carried out based on measurements of a parameter indicative of said polarization. Such measurements are obtained by means of a reference electrode also immersed in the electrolyte. More specifically, the ECU is adapted to measure an electrical potential of the metal part with the reference electrode as a ground reference, and to control the current between the anode and the metal part based on these measurements and the desired value, or desired interval, of the electrical potential of the metal part with the reference electrode as a ground reference. This desired value, or desired interval, depends on a number of circumstances, for example, the type of reference electrode used, and the type of electrolyte. As an example, where the metal part is made of a material from a certain group of copper alloys, and the electrolyte is salt water, the desired value of the electrical potential of the metal part with a silver chloride coated silver reference electrode as a ground reference is suitably within the interval −450 mV-(−600) mV. As a further example, where the same type of reference electrode is used in the same type of electrolyte, and the metal part is made of stainless steel, the desired value of the electrical potential of the metal part with the reference electrode as a ground reference is suitably −800 mV.

A problem when measuring the electrical potential of the metal part with the reference electrode as a ground reference is that severe measurement errors, so called IR drops, can occur. The reason is that when a current runs between the anode to the metal part through the electrolyte, an electrical field will be generated in the electrolyte. This electrical field will affect said potential measurement, and might result in an off-set which gives a corresponding off-set at the control of the electrical current between the anode and the metal part. As a result, the corrosion protection will be less than optimal.

Further, if more than one system are provided in the marine construction for corrosion protection of respective metal parts, a current running through the electrolyte from the anode of one system to one of the metal parts, will generate an electrical field which will affect the measurement, with a reference electrode as a ground reference, of the electrical potential of a metal part protected by another system.

It should be noted that if more than one system are provided in the marine construction for corrosion protection of respective metal parts, the first and second metal parts have to be galvanically isolated. In this presentation, for practical recreational boats, galvanic isolation means that the electrical resistance between the first and second metal parts is sufficiently high, preferably at least 50ω, more preferably at least 500ω, and most preferably at least 10 kω.

To overcome said IR drop problem, it is known to locate the reference electrode in a vicinity of the metal part surface, so that the distance between them is in the order of a few millimeters. Disadvantages of this solution include the lack of flexibility in the arrangement of the corrosion protection system, since it places high demands on the placement and geometry of the reference electrode.

It is also known to provide a tube, one end of which is located very close to the metal part, and at the other end of which the reference electrode is provided, whereby the tube acts as a shielded compartment for electrolyte within it, so that the latter is not affected by the electrical field between the anode and the metal part. This solution also results in a lack of flexibility in the arrangement of the corrosion protection system, since it places high demands on the placement and geometry of said tube and the reference electrode.

It is desirable to improve the corrosion protection by corrosion protection systems in marine constructions.

It is also desirable to reduce errors in the measurement of the electrical potential of a metal part with a reference electrode as a ground reference in a corrosion protection system in a marine construction.

It is a further desirable to reduce errors in the measurement of the electrical potential of a metal part with a reference electrode as a ground reference in a corrosion protection system in a marine construction, while allowing flexibility in the arrangement of the reference electrode.

It is also desirable to reduce errors in the measurement of the electrical potential of a metal part with a reference electrode as a ground reference in a corrosion protection system in a marine construction, while allowing a compact arrangement of parts in said system.

A method according to an aspect of the present invention comprises repetitively performing the steps of controlling the first and second electrical currents so as to be reduced or eliminated, measuring at least one of the first and second electrical potentials while said electrical currents are maintained reduced or eliminated, and, after measuring at least one of the first and second electrical potentials, controlling the first and second electrical currents so as to be increased or reestablished.

Thus, during operation of the corrosion protection system, there are time periods of unreduced electrical currents between the respective anode and the respective metal part, and intermittent time periods of simultaneously reduced or eliminated (interrupted) electrical currents, during which the electrical potential of the metal part with the reference electrode as a ground reference is measured.

Since during the measurement of the electrical potential of the metal part with the reference electrode as a ground reference, there is no electrical current between the respective metal part and the respective anode, there is also no electrical field, in the electrolyte between the active anode and the metal part, which could disturb the measurement. Also, since during the measurement of the electrical potential of the first metal part with the reference electrode as a ground reference, there is no electrical current between the second metal part and the second anode, there is also no electrical field, in the electrolyte between the second anode and the second metal part, which could disturb the measurement of the electrical potential of the first metal part with the reference electrode as a ground reference, and vice versa. This will provide for very accurate measurements of the electrical potential of the metal part(s) with the reference electrode as a ground reference, which in turn will make the control of the electrical current between the respective anode and the respective metal part more accurate. This will of course improve the corrosion protection of the metal parts.

When the current between the respective anode and the respective metal part is reduced or switched off, the electrical field generated thereby in the electrolyte is reduced or disappears immediately. However, the polarization of the respective metal part, which can be viewed as resembling a capacitor, decreases relatively slowly, and for this reason, it will be possible to measure the electrical potential accurately shortly after the current is reduced or turned off, and thereafter increase or turn on the current again, without having lost any substantial amount of the polarization.

Also, the invention, according to an aspect thereof, does not put any restrictions on the placement of the reference electrode in relation to the respective anode and the respective metal part, which allows for a large degree of flexibility in the arrangement of the corrosion protection system. Advantageously, the invention, according to an aspect thereof, allows for including the anodes and the reference electrode in a common unit adapted to be mounted externally of the marine construction to be at least partially immersed in the electrolyte. Thereby, a compact arrangement of the corrosion protection system can be maintained while obtaining the improved accuracy of the electrical current control. As exemplified below, where the marine construction is a boat, the common unit could be an external unit mounted on the transom of a boat.

It should be noted that an aspect of the invention is particularly advantageous for recreational boats, which often stay docked and for this reason are sensitive to excessive underwater growth caused by over-protection, i.e. the current between the respective anode and the respective metal part being too high. In other words, for recreational boats, an accurate current control in the corrosion protection system is of particular importance.

Of course, the metal part can be any part needing corrosion protection, such as a boat hull, a boat propulsion unit (drive) with a propeller, a trim tab or a metal swimming ladder. Further, the invention is equally applicable to ships, regardless whether they are military, rescue, research, transportation ships, or of some other type, and to off-shore installations, such as oil drilling platforms.

It should be noted that one or more reference electrodes can be provided solely for the measurement of the electrical potential of each metal part. Alternatively, one or more reference electrodes, herein also referred to as a common reference electrode, can be shared by two or more metal parts.

Preferably, at least one of the at least one reference electrode is a common reference electrode adapted to be used for measuring both said electrical potentials. Thereby, the number of reference electrodes in the system can be kept low. It should be noted that the first and second metal parts should be galvanically isolated. In this presentation, for practical recreational boats, galvanic isolation means that the electrical resistance between the first and second metal parts is sufficiently high, preferably at least 50ω, more preferably at least 500ω, and most preferably at least 10 kω. The absence of galvanic isolation will result in equalization of the electrical potential difference between the electrical parts. This in turn will result in the first or the second anode having to "work harder".

The common reference electrode adapted to be used for measuring both said electrical potentials can be integrated in the system in alternative manners. For example, measuring at least one of the first and second electrical potentials can comprise measuring the first potential while the second metal part is disconnected from the common reference electrode using a switch, and measuring the second potential while the first metal part is disconnected from the common reference electrode. Alternatively, both electrical potentials can be measured simultaneously, while it is secured that the electrical resistance between the first and second metal parts is sufficiently high, as mentioned above.

Preferably, the corrosion protection system comprises at least one impressed current cathodic protection system, at least the first anode being an active anode, and controlling the first electrical current comprises controlling an electrical power supply to the active anode and the first metal part.

Thereby, the invention, according to an aspect thereof, is adapted to an ICCP system. More specifically, controlling the first electrical current so as to be reduced or eliminated, comprises controlling the electrical power supply to the active anode and the first metal part so as to be reduced or discontinued. Further, measuring the first electrical potential while the first electrical current is maintained reduced or eliminated, comprises measuring the first electrical potential while the electrical power supply to the active anode and the first metal part is maintained reduced or discontinued. In addition, controlling said first electrical current so as to be increased or reestablished, comprises controlling the electrical power supply to the active anode and the first metal part so as to be increased or resumed.

Alternatively, or in addition, the corrosion protection system comprises at least one passive corrosion protection system, at least the second anode being a sacrificial anode, and controlling the second electrical current comprises controlling an adjustable resistance in an electrical connection between the sacrificial anode and the second metal part.

Thereby, the invention, according to an aspect thereof, is adapted to a passive corrosion protection system with a sacrificial anode, herein also referred to as a passive anode. More specifically, controlling the second electrical current so as to be reduced or eliminated, can comprise controlling the adjustable resistance so that the resistance thereof is increased, so that in turn the second electrical current is reduced or eliminated. Alternatively, controlling said second electrical current so as to be reduced or eliminated, can comprise controlling a relay or a switch so that the second current is eliminated. Further, measuring the second electrical potential while said second electrical current is maintained reduced or eliminated, comprises measuring the second electrical potential while the resistance of the adjustable resistance is maintained at an increased level, or, where applicable, while the second current is maintained eliminated by the relay or the switch. In addition, controlling the second electrical current so as to be increased or reestablished, comprises controlling the adjustable resistance so as to the resistance thereof is decreased, or, where applicable, controlling the relay or the switch so that the second current is reestablished.

Preferably, the steps of controlling the first and second electrical currents so as to be reduced or eliminated comprise eliminating or reducing the first and/or the second electrical currents at least 75%. Thereby, said electrical currents can be reduced from their respective momentary values in the current closed loop controls, i.e. the current values provided to obtain desired values for surface polarizations at the interfaces between the metal parts and the electrolyte, so as to reach a level being not more than 25% of said momentary values. In particularly preferred embodiments, the steps of controlling said electrical currents so as to be reduced or eliminated comprise eliminating or reducing said electrical currents at least 90%, preferably at least 95%. These reductions secure that the corresponding electrical fields in the electrolyte is reduced so as not to interference to any substantial degree with the measurement.

Where the invention is applied to an ICCP system, this can be done by discontinuing or reducing the electrical power to the active anode and the metal part so that the absolute value of an electrical tension applied between the active anode and the metal part is not more than 25% of the momentary absolute value of said electrical tension in the electrical power closed loop control.

However, it should be noted that in some embodiments, the first and/or the second electrical current is controlled so as to be eliminated while the electrical potentials of the metal parts with the reference electrode(s) as a ground reference are measured. Thereby, the first and/or the second electrical current are off completely during the measurement, so that there is no electrical field in the electrolyte between the respective anode and the respective metal part.

Preferably, as described closer below, the steps of controlling the first and second electrical currents so as to be reduced or eliminated and/or the steps of controlling the first and second electrical currents so as to be increased or reestablished comprise controlling the first and/or the second electrical current according to a ramp function.

Preferably, each time period, during which said electrical currents are maintained reduced or eliminated, is not above 1 second, more preferably not above 500 ms. Preferably, a ratio between time periods, during which said electrical currents are not maintained reduced or eliminated, and time periods, during which said electrical currents are maintained reduced or eliminated, is at least ten. As explained closer below, this will secure that enough time is provided for maintaining the polarization of the metal part in relation to the intermittent periods for measurement of the electrical potential of the metal part.

DESCRIPTION OF THE FIGURES

Below, the invention will be described in detail with reference to the drawings, in which.

DETAILED DESCRIPTION

Figure 1:
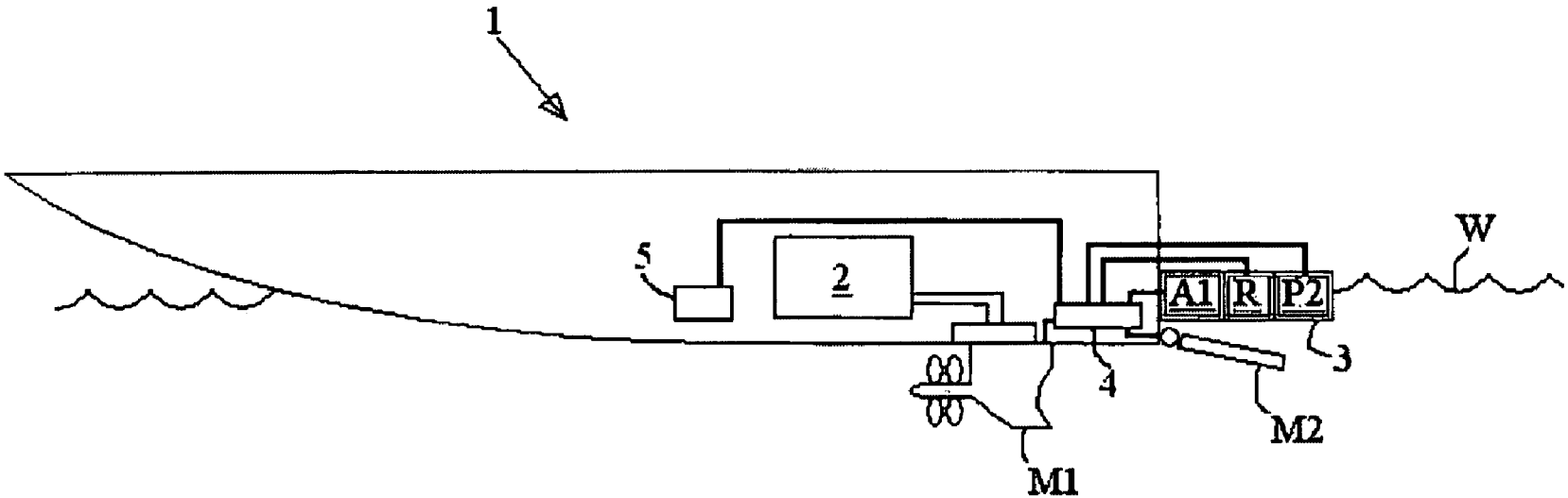
FIG. 1 shows a schematic cross-sectional side view of a boat.

FIG. 1 shows a schematic cross-sectional side view of a boat 1 with a corrosion protection system. The boat 1 is provided with an engine 2 connected to a drive M1, with propellers for the propulsion of the boat. In this example, the drive M1, made in a copper alloy and immersed in the water W, constitutes a first metal part to be protected by the corrosion protection system. In FIG. 1, the drive M1 is schematically presented as a drive M1 manufactured and marketed by Volvo Penta as an IPS (Inboard Performance System) drive, but the invention is of course applicable to boats with any kind of drive, for example a stern drive or a traditional propeller and rudder combination.

The boat is also provided with two trim tabs M2, only one of which is schematically presented in FIG. 1. The trim tabs M2 are mounted on at a transom of the boat in a manner known in the art. In this example, the trim tabs M2, made in stainless steel and immersed in the water W, constitute second metal parts to be protected by the corrosion protection system.

It should be noted that the drive M1 and the trim tabs M2 are galvanically isolated, which means that the electrical resistance between the drive M1 and the trim tabs M2 is at least 50ω, more preferably at least 500ω), and most preferably at least 10 kω.

The corrosion protection system comprises an external unit 3, mounted on the transom of the boat 1. The external unit 3 is adapted to be at least partly immersed in the water, and comprises an anode in the form of an active anode A1 which is provided for the corrosion protection of the drive M1, and herein also referred to as a first anode A1. The active anode A1 can be provided in the form of a MMO (mixed metal oxide) coated titanium rod. Alternatively, the active anode A can be provided as a platinum coated titanium rod. Alternative shapes for the active anode A include tubular shapes and shapes as continuous ribbons, and alternative materials include high silicon cast iron, graphite and niobium.

The external unit 3 also comprises, for the corrosion protection of the trim tabs M2, an anode in the form of a passive anode P2, herein also referred to as a second anode P2, which is a sacrificial anode that can be made of very pure zinc.

In addition, the external unit 3 comprises a reference electrode R, which is supplied in the form of a solid rod made of silver coated with silver chloride.

The corrosion protection system also comprises an electronic control unit (ECU) 4, to which the drive M1, the trim tabs M2, the first anode A1, the reference electrode R and the second anode P2 are connected. Also, an electrical power source 5, in the form of a 12 volt, or a 24 volt, DC battery, is connected to the ECU 4.

Figure 2:
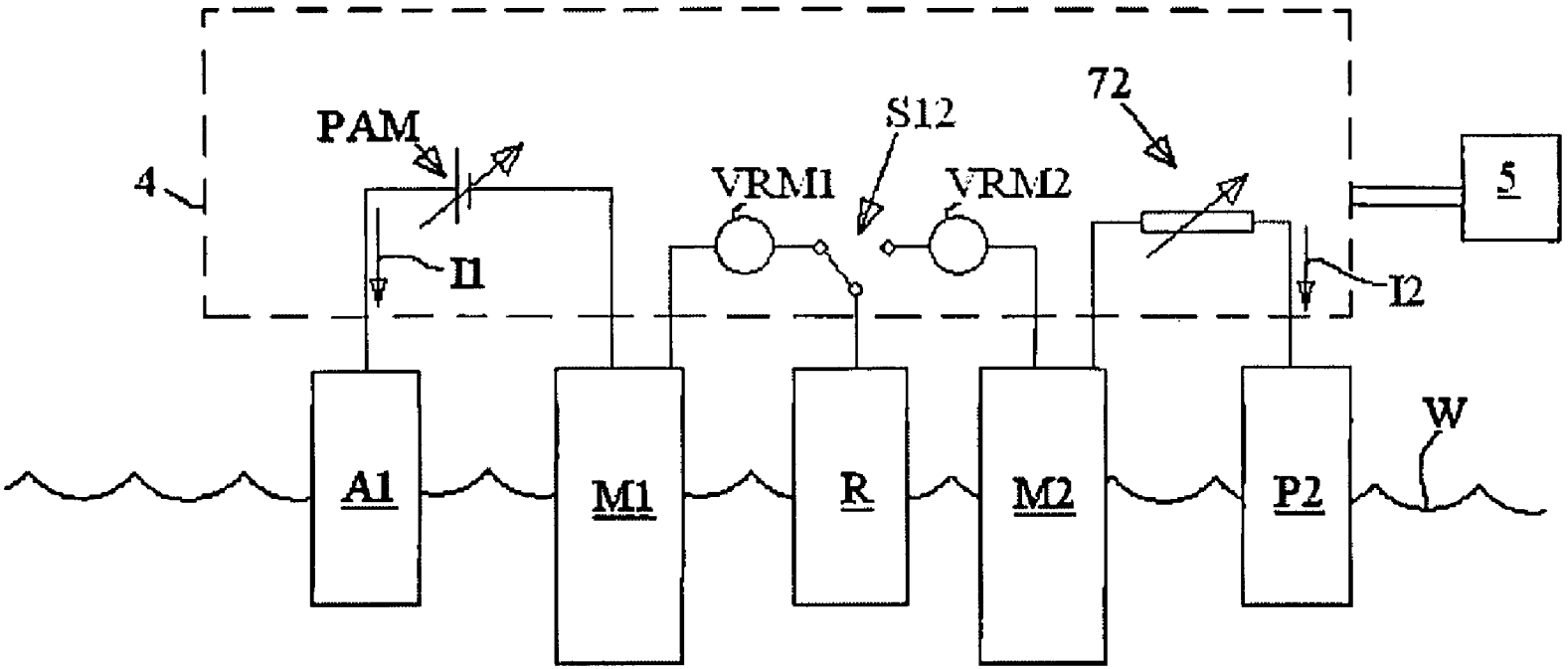
FIG. 2 shows, with parts represented as blocks, a depiction of a corrosion protection system of the boat in FIG. 1.

FIG. 2 shows a schematic representation of the corrosion protection system of the boat in FIG. 1. The battery 5 (FIG. 1) is connected to, and adapted to provide electrical power PAM to the active anode A1 and the drive M1. This connection is provided via the ECU 4, which is adapted to vary and control the electrical power PAM to the active anode A1 and the drive M1, as indicated with the sign in FIG. 2 at the arrow PAM.

The ECU 4 is adapted to measure a first electrical potential VRM1 of the drive M1 with the reference electrode R as a ground reference. The first electrical potential VRM1 is indicative of the surface polarization at the interface between the drive M1 and the water W. As described in more detail below, the ECU 4 is further adapted to control the electrical power PAM to the active anode A1 and the drive M1 based partly on the measured first electrical potential VRM1 of the drive M1 with the reference electrode R as a ground reference. Through the control of the electrical power PAM, a first electrical current (indicated in FIG. 2 with an arrow II), through an electrical circuit comprising the active anode A1, the first metal part M1 and the electrolyte W, is controlled.

More specifically, the parameter of interest for control of the corrosion protection of the drive M1 is the electrical potential of the drive M1 with the reference electrode as a ground reference, corresponding to the surface polarization at the interface between the drive M1 and the water W, and the electrical power PAM to the active anode A1 and the drive M1 is subjected to a closed loop control so as for said surface polarization to assume a desired value. In this example, the drive M1 is made of a copper alloy, and it is assumed that the desired value of the electrical potential of the drive M1 with the reference electrode R as a ground reference is −450 mV.

Thus, the corrosion protection system for the drive M1 comprises an ICCP system with the active anode A1, the reference electrode R, the battery 5 and the ECU 4.

The corrosion protection system for the trim tabs M2 comprises a passive corrosion protection system with the passive anode P2 and the ECU 4. The ECU 4 is adapted to measure a second electrical potential VRM2 of the trim tabs M2 with the reference electrode R as a ground reference. The second electrical potential VRM2 is indicative of the surface polarization at the interface between the trim tabs M2 and the water W. As described in more detail below, the ECU 4 is further adapted to control an adjustable resistance 72 in the electrical connection between the passive anode P2 and the trim tabs M2 based partly on the measured second electrical potential VRM2 of the trim tabs M2 with the reference electrode R as a ground reference. Through control of the adjustable resistance 72 an electrical current between the passive anode P2 and the trim tabs M2, herein also referred to as a second electrical current (indicated in FIG. 2 with an arrow 12), is controlled. Thus, the second electrical current 12 runs through an electrical circuit comprising the passive anode P2, the trim tabs M2 and the electrolyte W.

More specifically, the parameter of interest for control of the corrosion protection of the trim tabs M2 is the electrical potential of the trim tabs M2 with the reference electrode as a ground reference, corresponding to the surface polarization at the interface between the trim tabs M2 and the water W, and the second electrical current 12 is subjected to a closed loop control so as for said surface polarization to assume a desired value. In this example, the trim tabs M2 are made of stainless steel, and it is assumed that the desired value of the electrical potential of the trim tabs M2 with the reference electrode R as a ground reference is −800 mV.

Since the reference electrode R is a common reference electrode, i.e. is used for the two tasks of measuring the first electrical potential VRM1, and measuring the second electrical potential VRM2, a switch, herein referred to as a reference switch S 12 is controllable by the ECU 4 for connecting the reference electrode to either the drive M1 or the trim tabs M2. Thereby, there will be at no time any galvanic connection between the drive M1 and the trim tabs M2, and this is an prerequisite for a proper function of the corrosion protection system. However, as exemplified below, in alternative embodiments, it is of course possible to provide for each of the drive M1 and the trim tabs M2, one or more reference electrodes R dedicated only for the electrical potential measurement of the drive M1 and the trim tabs M2, respectively.

Figure 3:
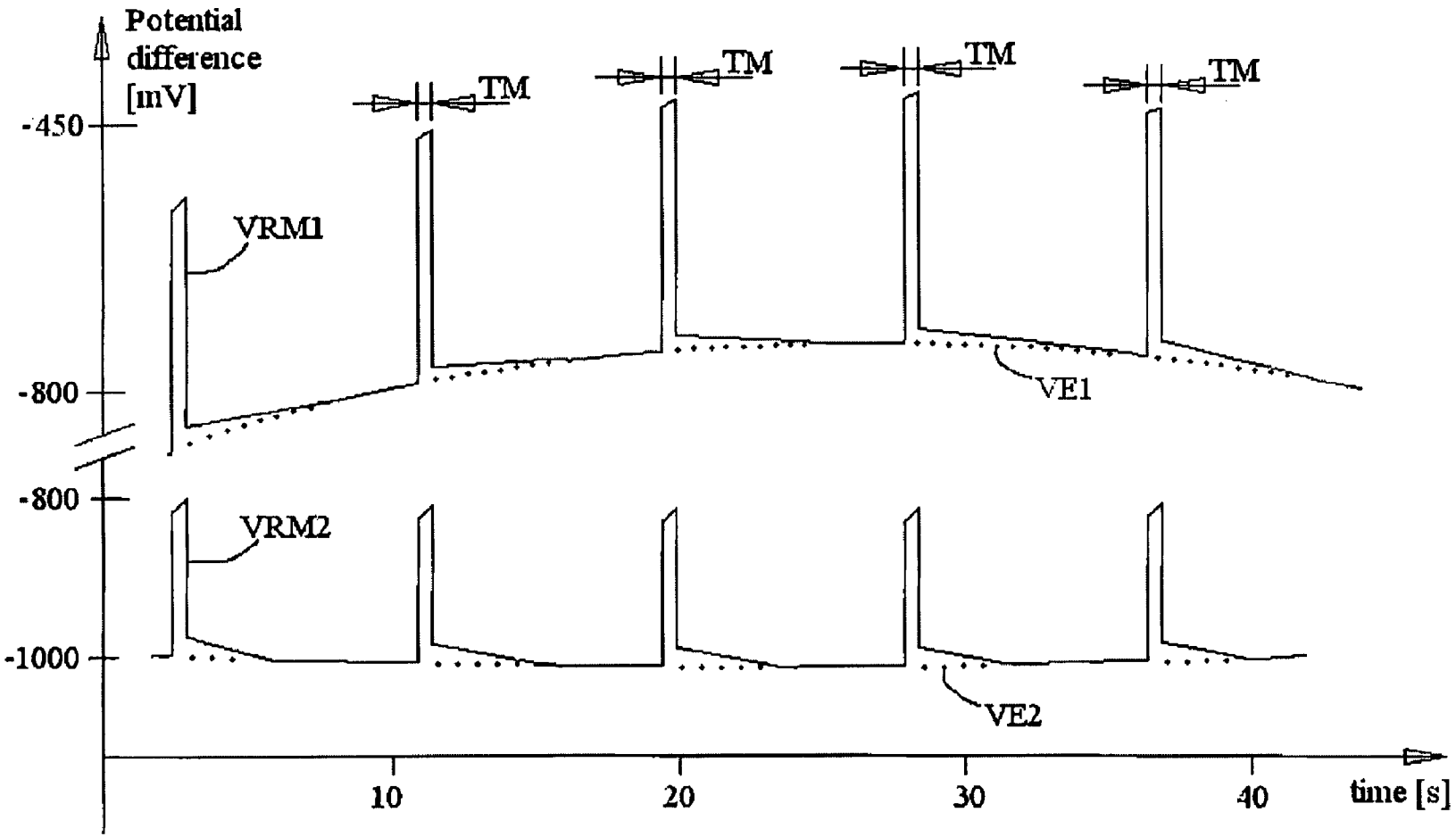
FIG. 3 is a diagram showing an electrical potential, with a certain reference electrode as a ground reference, in the corrosion protection system as a function of time, FIG. 4 corresponds to FIG. 2, with the exception that lines representing electrical fields have been added.
Figure 4:
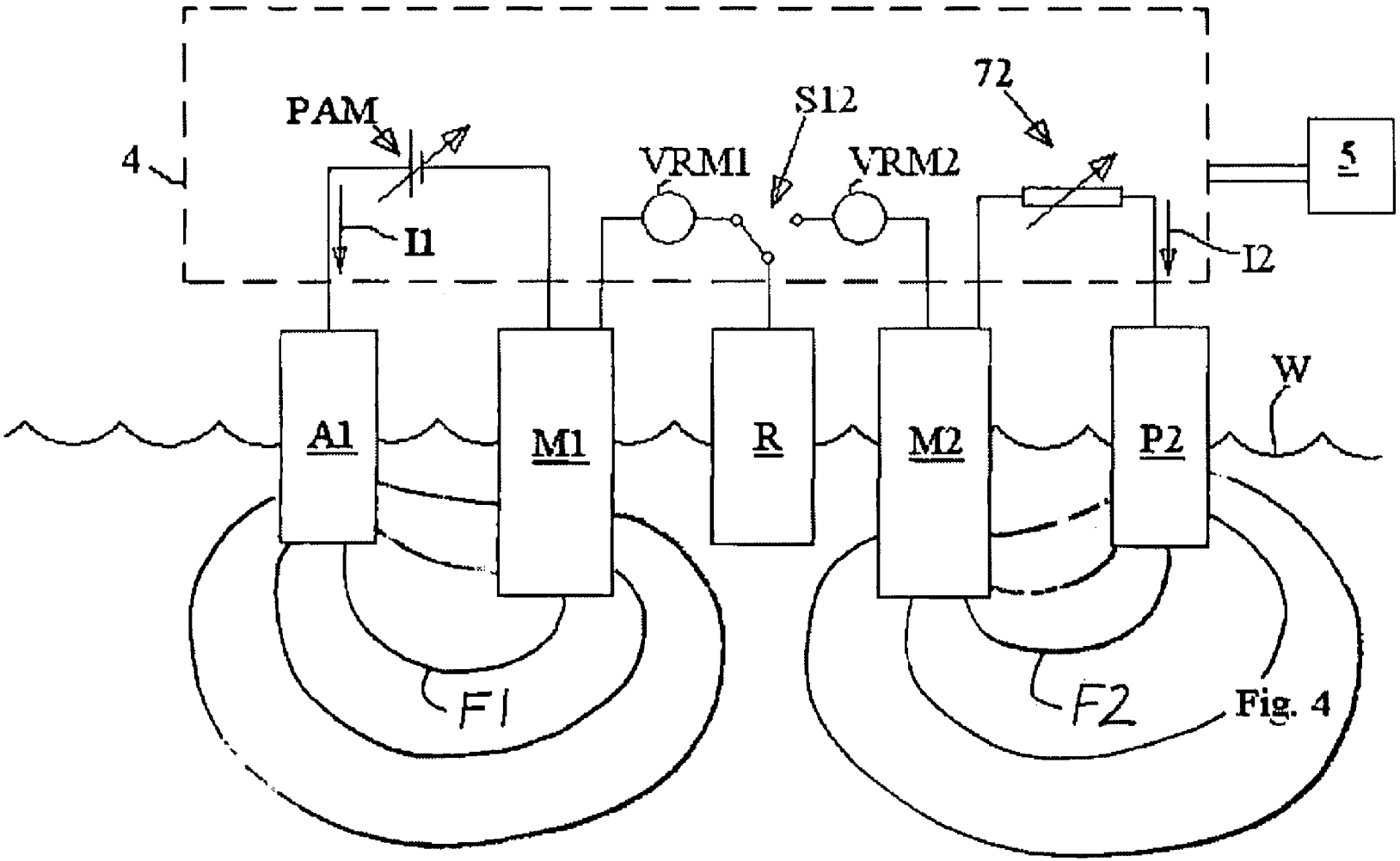

Reference is made to FIG. 3 and FIG. 4. When electrical power is allowed from the battery 5 to the active anode A1 and the drive M1, a circuit through the water W is closed. Thereby the power fed to the active anode A1 and the drive M1 gives rise to a first electrical field in the water W, illustrated in FIG. 4 with curves F1. Simultaneously, the second electrical current 12 is allowed between the passive anode P2 and the trim tabs M2, giving rise to a second electrical field in the water W, illustrated in FIG. 4 with curves F2.

FIG. 3 gives an example of the first and second potentials VRM1, VRM2 as functions of time. A first dotted line VE1 indicates as a function of time the electrical potential of the drive M1 with the reference electrode R as a ground reference in case of an uninterrupted feeding of electrical power from the battery 5 to the active anode A1 and the drive M1 at levels close to a desired value. As stated, in this example, it is assumed that the desired value of the electrical potential of the drive M1, made in a copper alloy, is −450 mV. The deviation of the values of the first dotted line VE1 from the desired value of the electrical potential of the drive M1, −450 mV, is caused by the first and second electrical fields F1, F2, (FIG. 4). A second dotted line VE2 indicates as a function of time the electrical potential of the trim tabs M2 with the reference electrode R as a ground reference in case of an uninterrupted electrical current between the passive anode P and the trim tabs M2 when obtaining a surface polarization of the trim tabs M2 close to a desired value. The deviation of the values of the second dotted line VE2 from the desired value of the electrical potential of the trim tabs M2, made in stainless steel, −800 mV, is caused by the first and second electrical fields F1, F2, (FIG. 4).

For obtaining an accurate feedback for the closed loop controls of the first and second electrical currents II, 12, the ECU 4 is adapted to control the electrical power from the battery 5 to the active anode A1 and the drive M1, and the adjustable resistance 72 so that during recurrent measurement time periods TM, there is no electrical power from the battery 5 to the active anode A1 and the drive M1, and so that the adjustable resistance 72 presents a very high electrical resistance, so that there is no second electrical current 12 between the passive anode P2 and the trim tabs M2. Simultaneously turning off the power to the active anode A1 and the drive M1 and providing a very high electrical resistance by the adjustable resistance 72 will result in the first and second electrical fields F1, F2 (FIG. 4) disappearing practically immediately. Therefore, as can be seen in FIG. 3, the first and second electrical potentials VRM1, VRM2 will increase practically immediately to values at which they correspond to the true surface polarizations of the drive M1 and the trim tabs M2, respectively.

It should be mentioned that control of the electrical power from the battery to the active anode A1 and the drive M1 can alternatively be supplied with an adjustable resistance (not shown) in the first electrical circuit including the active anode and the drive.

During a first phase of the measurement time period TM, the reference switch S 12 provides a connection between the reference electrode R and the drive M1, at which the reference electrode R is disconnected from the trim tabs M2. Thereby, at least one value of the first electrical potential VRM1 of the drive M1 with the reference electrode R as a ground reference will be registered by the ECU 4 as a feedback for said closed loop control of the first electrical current II.

After the first phase of the measurement time period TM, during a second phase of the measurement time period TM, the reference switch S 12 provides a connection between the reference electrode R and the trim tabs M2, at which the reference electrode R is disconnected from the drive M1. Thereby, at least one value of the second electrical potential VRM2 of the trim tabs M2 with the reference electrode R as a ground reference will be registered by the ECU 4 as a feedback for said closed loop control of the second electrical current 12.

Thereafter, the measurement time period TM will be terminated by switching on the electrical power from the battery 5 to the active anode A1 and the drive M1, and decreasing the resistance of the adjustable resistance 72, which again will cause the first and second electrical potentials VRM1, VRM2 to become more negative.

Thus, since, while measuring the first and second electrical potentials VRM1, VRM2, there is no electrical power from the battery 5 to the drive M1 and the active anode A1, and no current between the passive anode P2 and the trim tabs M2, there is also no local electrical fields F1, F2 in the electrolyte W (water) between the active anode A1 and the drive M1, or between the passive anode P2 and the trim tabs M2, which could disturb the measurements.

While the electrical power from the battery 5 to the drive M1 and the active anode A1 is off, and the resistance of the second electrical resistance 72 is increased, the electrical potentials of the drive M1 and the trim tabs M2 will relatively slowly move towards zero. Therefore, it is desirable to keep each time period TM, during which said electrical power is off, and said resistance is very high, as short as possible. In the example in FIG. 3, each time period, during which said electrical power is off, and said resistance is very high, is 500 ms. Preferably, in general, each time period TM, during which said electrical power is off, and said resistance is very high, is not above 500 ms. In the example in FIG. 3, each time period, during which the first and second electrical currents II, 12 are allowed, is 8 seconds, which means that the ratio between the time periods, during which the first and second electrical currents II, 12 are allowed, and the time periods, during which the first and second electrical currents II, 12 are not allowed, is 16. Preferably, in general, said ratio is at least 10. This will secure that enough time is provided for maintaining the surface polarization of the drive M1 and the trim tabs M2 in relation to the intermittent periods for measurement of the electrical potentials VRM1, VRM2.

In an alternative embodiment, the electrical currents II, 12 are not completely reduced to zero, i.e. discontinued, when the first and second electrical potentials VRM1, VRM2 are measured. Instead, during time periods TM (FIG. 3), during which said electrical potentials are measured, said electrical currents II, 12 are controlled to be reduced but not interrupted. To secure that the remaining electrical fields F1, F2 (FIG. 4) in the electrolyte W do not to a substantial degree disturb the measurements, the electrical currents II, 12 are each reduced at least 75%.

It is also possible to reduce, during said measurement, the first electrical current to zero, and to reduce, during said measurement, the second electrical current at least 75% but not to zero, and vice versa.

Figure 5:
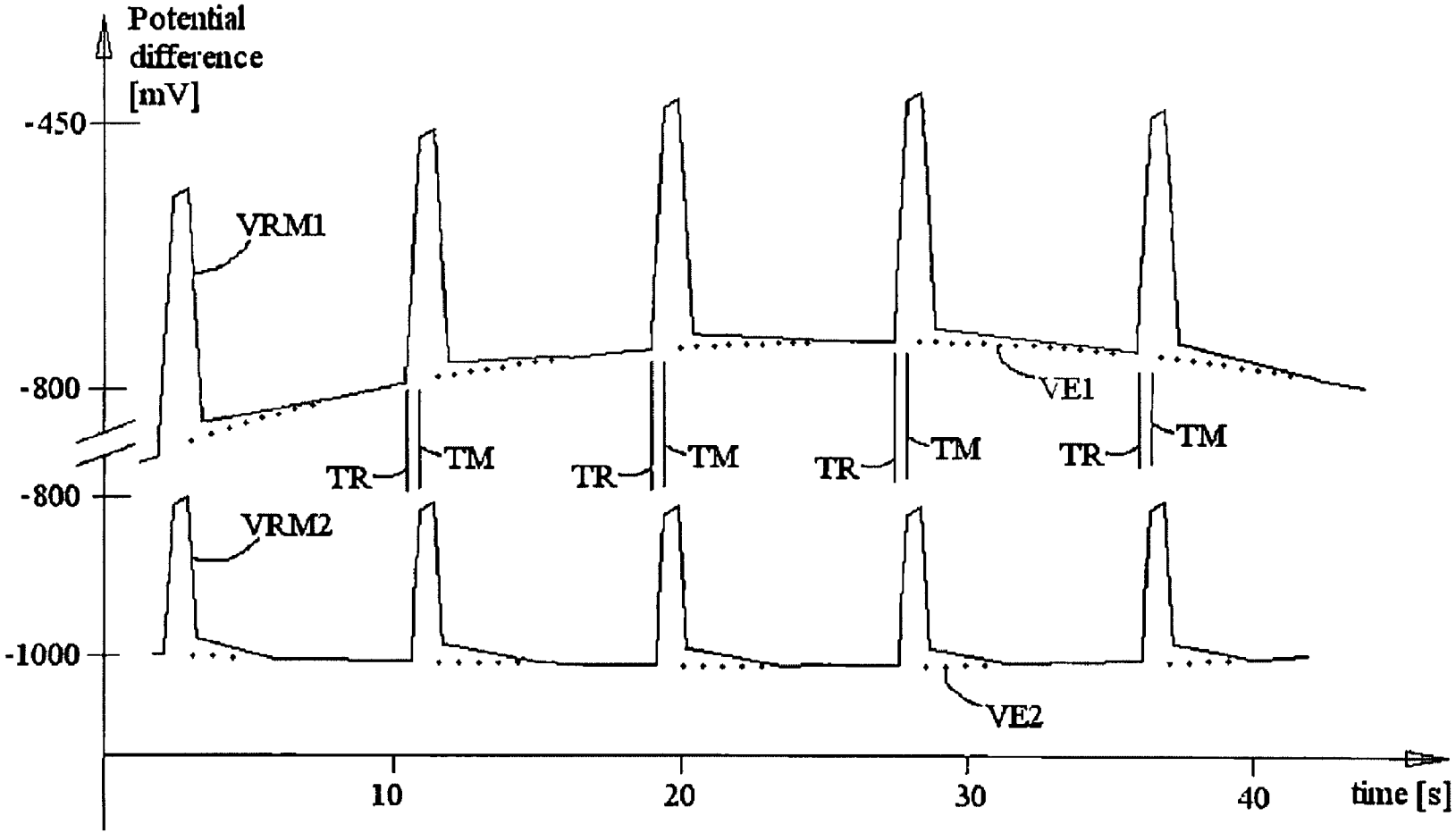
FIG. 5 is a diagram showing, as a function of time, an electrical potential, with a certain reference electrode as a ground reference, in a corrosion protection system according to an alternative embodiment of the invention.

FIG. 5 is a diagram showing, as a function of time, first and second electrical potentials VRM1, VRM2 in corrosion protection system according to an alternative embodiment of the invention. The hardware configuration of the system is the same as described above with reference to FIG. 1 and FIG. 2. As in the embodiment described above, the first and second electrical currents II, 12 are repetitively controlled so as to be discontinued. Differing from the embodiments described above, in FIG. 5, each time the first and second electrical currents II, 12 are to be discontinued, they are decreased towards zero according to a ramp function. In FIG. 5, this decrease ramp function is commenced at points in time denoted TR, and ended at points in time denoted TM.

Similarly to what has been described above, at the points in time denoted TM, the reference switch S 12 provides a connection between the reference electrode R and the drive M1, and the first electrical potential VRM1 is registered by the ECU 4. Thereafter, the reference switch S 12 provides a connection between the reference electrode R and the trim tabs M2, and the second electrical potential VRM2 is registered by the ECU 4. Thereafter, the electrical currents H, 12 are resumed with a further ramp function. Such ramping of the electrical currents II, 12 is advantageous for avoiding wear of components in the ECU 4 due to rapid switching of first electrical currents at measurements of said first electrical potential VRM1.

In alternative embodiments, there could be more than two metal parts M1, M2, each protected by their individual passive or active anode A1, P2, at which synchronized interruption of the currents II, 12 in the respective circuits are provided when the potentials VRM1, VRM2 between the metal parts M1, M2 and one or more reference electrodes R are measured. Also, there could be different combinations of active and passive systems; for example, as an alternative to the examples described above with reference to FIG. 1-FIG. 5, both metal parts M1, M2 could be protected by active systems, each presenting an active anode. Thereby, there could be two batteries 5, each providing electrical power to the respective pairs of active anodes and metal parts. In a further alternative, both metal parts M1, M2 could be protected by passive systems.

Figure 6:
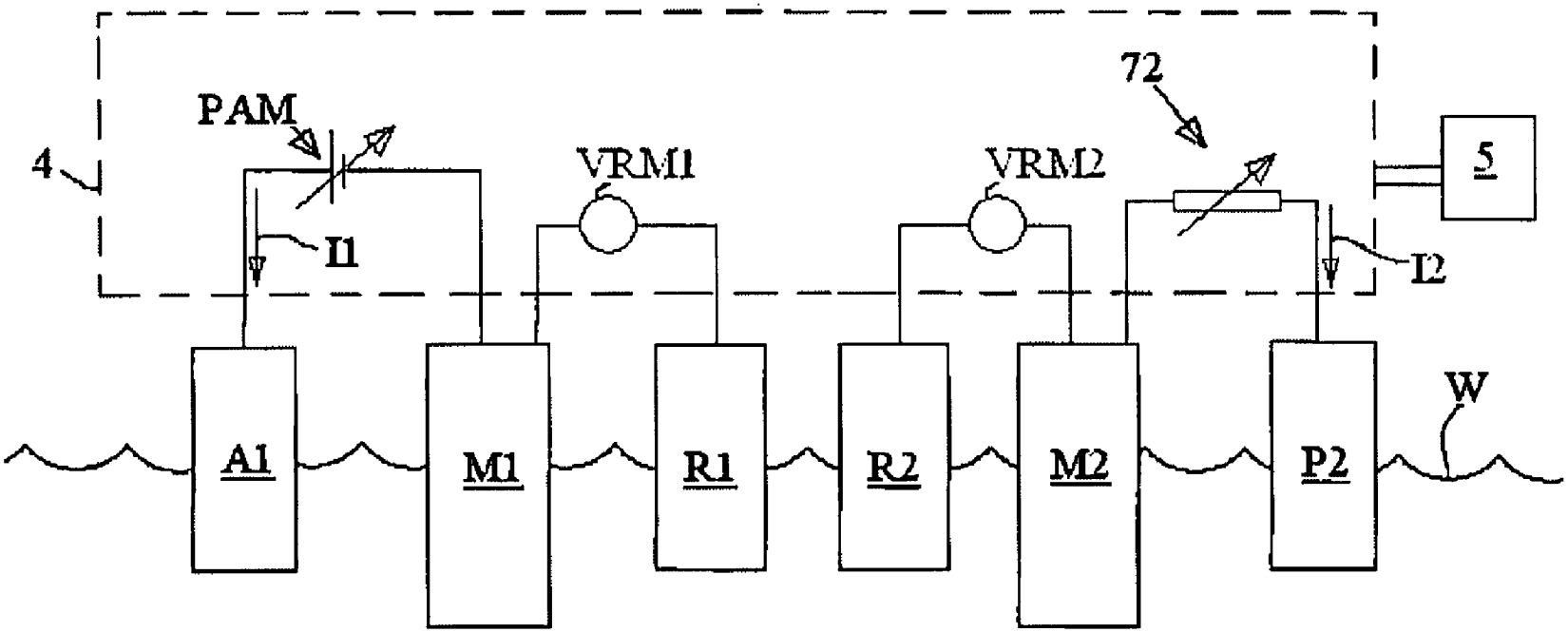
FIG. 6 shows, with parts represented as blocks, a depiction of a corrosion protection system according to an alternative embodiment of the invention.

FIG. 6 shows, with parts represented as blocks, a depiction of a corrosion protection system for a boat according to an alternative embodiment of the invention, similar to the ones that have been described above, except for the following feature: For the drive M1 a separate first reference electrode R1 is provided; and for the trim tabs M2, a separate second reference electrode R2 is provided. Thus, the first and second reference electrodes are dedicated only for the measurement the electrical potential VRM1, VRM2 of the drive M1 and the trim tabs M2, respectively. Thereby, no reference switch S12 (FIG. 2) is needed. Instead, (see FIG. 3), during the measurement time period TM, the first electrical potential VRM1 of the drive M1 with the first reference electrode R1 as a ground reference, and the second electrical potential VRM2 of the trim tabs M2 with the second reference electrode R2 as a ground reference, can be measured simultaneously.

It should be mentioned that the invention is applicable to boats with any number of engines and drives. Thereby, the engines or the drives can be bonded, i.e. galvanically connected, so as to provide corrosion protection from a common anode, in a manner corresponding to the ones described below. More generally, the electronic control unit 4 can be adapted to control the first (or the second) electrical current II through an electrical circuit comprising the first (or second) anode A1, P1, the first (or second) metal part M1, the electrolyte W, and a further metal part galvanically connected to said first (or second) metal part M1.

The invention claimed is:

1. A method in a corrosion protection system for protecting a first and a second metal part of a marine construction, the method comprising controlling a first electrical current through a first electrical circuit, comprising a first anode, the first metal part and an electrolyte, at least partly based on a measured first electrical potential of the first metal part with at least one of the at least one reference electrode (R, RI) as a ground reference;

controlling a second electrical current through a second electrical circuit, comprising a second anode, the second metal part and the electrolyte, at least partly based on a measured second electrical potential of the second metal part with at least one of the at least one reference electrode as a ground reference, and repetitively performing the steps of controlling the first and second electrical currents so as to be reduced or eliminated, measuring at least one of the first and second electrical potentials while the electrical currents are maintained reduced or eliminated, and, after measuring at least one of the first and second electrical potentials, controlling the first and second electrical currents so as to be increased or reestablished.

2. A method according to claim 1, wherein at least one of the at least one reference electrode is a common reference electrode adapted to be used for measuring both the electrical potentials.

3. A method according to claim 1, wherein the corrosion protection system comprises at least one impressed current cathodic protection system, at least the first anode being an active anode, and controlling the first electrical current comprises controlling an electrical power supply to the active anode and the first metal part.

4. A method according to claim 1, wherein the corrosion protection system comprises at least one passive corrosion protection system, at least the second anode being a sacrificial anode, and controlling the second electrical current comprises controlling an adjustable resistance in an electrical connection between the sacrificial anode and the second metal part.

5. A method according to claim 1, wherein the steps of controlling the first and second electrical currents so as to be reduced or eliminated comprise eliminating or reducing the first and! or the second electrical currents at least 75%.

6. A method according to claim 1, wherein the steps of controlling the first and second electrical currents so as to be reduced or eliminated and/or the steps of controlling the first and second electrical currents so as to be increased or reestablished comprise controlling the first and/or the second electrical current according to a ramp function.

7. A method according to claim 1, wherein each time period, during which the electrical currents are maintained reduced or eliminated, is not above 1 second.

8. A method according to claim 1, wherein a ratio between time periods, during which the electrical currents are not maintained reduced or eliminated, and time periods, during which the electrical currents are maintained reduced or eliminated, is at least ten.

9. A corrosion protection system for protecting a first and a second metal part of a marine construction, such as a marine surface vessel or a marine structure; the system comprising an electronic control unit (4) adapted to measure a first electrical potential of the first metal part with at least one of the at least one reference electrode (R, RI) as a ground reference, to control a first electrical current through a first electrical circuit, comprising a first anode, the first metal part and an electrolyte, at least partly based on the measured first electrical potential, to measure a second electrical potential of the second metal part with at least one of the at least one reference electrode as a ground reference, and to control a second electrical current through a second electrical circuit, comprising a second anode, the second metal part and the electrolyte, at least partly based on the measured second electrical potential, wherein the electronic control unit is adapted to repetitively perform the steps of controlling the first and second electrical currents so as to be reduced or eliminated, measuring at least one of the first and second electrical potentials while the electrical currents are maintained reduced or eliminated, and, after measuring at least one of the first and second electrical potentials, controlling the first and second electrical currents so as to be increased or reestablished.

10. A system according to claim 9, wherein at least one of the at least one reference electrode is a common reference electrode adapted to be used for measuring both the electrical potentials.

11. A system according to claim 9, wherein the corrosion protection system comprises at least one impressed current cathodic protection system, at least the first anode being an active anode (AI), and the electronic control unit is, for the control of the first electrical current, adapted to control an electrical power supply to the active anode and the first metal part.

12. A system according to claim 9, wherein the corrosion protection system comprises at least one passive corrosion protection system, at least the second anode being a sacrificial anode, and the electronic control unit is, for the control of the second electrical current, adapted to control an adjustable resistance in an electrical connection between the sacrificial anode and the second metal part.

13. A system according to claim 9, wherein the electronic control unit (4) is adapted to perform the steps of controlling the first and second electrical currents so as to be reduced or eliminated, by eliminating or reducing the first and/or the second electrical currents at least 75%.

14. A system according to claim 9, wherein the anodes and the at least one reference electrode are included is a common external unit (3) adapted to be mounted externally of the marine construction to be at least partially immersed in the electrolyte.

15. A system according to claim 9, wherein the first electrical circuit comprises the first anode, the first metal part, the electrolyte, and a further metal part galvanically connected to the first metal part.

16. A marine vessel with a corrosion protection system according to claim 9.

* * * * *